US009537248B2

(12) United States Patent
Hung

(10) Patent No.: US 9,537,248 B2
(45) Date of Patent: Jan. 3, 2017

(54) CONNECTOR STRUCTURE OF TRANSMISSION LINE AND TRANSMISSION LINE

(71) Applicant: DELTA ELECTRONICS, INC., Taoyuan (TW)

(72) Inventor: Ruei-Lin Hung, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 14/939,533

(22) Filed: Nov. 12, 2015

(65) Prior Publication Data

US 2016/0218459 A1 Jul. 28, 2016

(30) Foreign Application Priority Data

Jan. 26, 2015 (TW) ..... 104102521 A

(51) Int. Cl.

| | |
|---|---|
| ***H01R 13/502*** | (2006.01) |
| ***H01R 13/50*** | (2006.01) |
| ***H01R 27/00*** | (2006.01) |
| ***H01R 31/06*** | (2006.01) |
| ***H01R 25/00*** | (2006.01) |
| *H01R 13/60* | (2006.01) |
| *H01R 24/60* | (2011.01) |

(52) U.S. Cl.

CPC ..... *H01R 13/502* (2013.01); *H01R 13/501* (2013.01); *H01R 25/00* (2013.01); *H01R 27/00* (2013.01); *H01R 31/06* (2013.01); *H01R 13/60* (2013.01); *H01R 24/60* (2013.01)

(58) Field of Classification Search

USPC ..... 439/217, 345, 660, 818, 460, 598, 277,439/354

See application file for complete search history.

(56) References Cited

U.S. PATENT DOCUMENTS 2,967,722 A * 1/1961 Lifka ..... H01B 17/34 285/179.1
4,193,665 A * 3/1980 Arnold ..... G02B 6/3874 385/54
4,283,597 A * 8/1981 Cooper, Jr. ..... H01B 17/58 174/138 F (Continued)

FOREIGN PATENT DOCUMENTS

CN 202888571 U 4/2013
CN 203339445 U 12/2013

(Continued)

*Primary Examiner* — Alexander Gilman
(74) *Attorney, Agent, or Firm* — Muncy, Geissler, Olds & Lowe, P.C.

(57) ABSTRACT

A connector structure of a transmission line is disposed at one end of a cable. The connector structure includes an elastic sleeve, a first connector module, and a second connector module. The elastic sleeve has an opening or slit. The first connector module is covered by the elastic sleeve. One end of the first connector module has a first plug, and the other end has a first socket. The second connector module is covered by the elastic sleeve. One end of the second connector module has a second plug, and the other end is connected to the cable. The second plug can be pluggably connected with the first socket. The opening or slit is located adjacent to the junction part between the first connector module and the second connector module.

9 Claims, 17 Drawing Sheets

(56) References Cited

U.S. PATENT DOCUMENTS 4,406,515 A * 9/1983 Roberts ..... G02B 6/3835 385/62
4,411,491 A * 10/1983 Larkin ..... H01R 13/523 385/59
4,643,505 A * 2/1987 House ..... H01R 13/6392 174/92
4,940,424 A * 7/1990 Odbert ..... H01R 13/6392 439/314
5,101,463 A * 3/1992 Cubukciyan ..... G02B 6/3831 385/69
5,132,495 A * 7/1992 Ewing ..... H02G 15/18 174/138 F
5,179,607 A * 1/1993 Sellers ..... G02B 6/3825 385/70
5,239,603 A * 8/1993 Sonoda ..... G02B 6/3877 264/1.1
5,621,834 A * 4/1997 Anderson ..... G02B 6/3874 385/72
5,772,462 A * 6/1998 Osten ..... H01R 13/6392 439/367
5,915,998 A * 6/1999 Stidham ..... H01R 4/36 439/521
5,938,475 A * 8/1999 Penner ..... H01R 9/0527 439/607.44
6,263,567 B1 * 7/2001 McGrane ..... H01R 43/16 29/874
6,347,966 B1 * 2/2002 Hielscher ..... B21K 25/00 29/874
6,359,226 B1 * 3/2002 Biddell ..... H01R 4/22 174/74 A
6,406,068 B1 * 6/2002 Bartholoma ..... F16L 5/14 285/208
6,593,531 B2 * 7/2003 Hulsmann ..... F16L 45/00 174/66
6,653,568 B1 * 11/2003 Davis ..... H02G 3/0481 174/135
6,809,266 B1 * 10/2004 Hoi ..... H02G 1/085 174/135
6,981,423 B1 * 1/2006 Discenzo ..... G01L 3/12 73/800
7,056,151 B2 * 6/2006 Cawood ..... H01R 4/70 439/521
7,453,042 B2 * 11/2008 Low ..... H02G 15/013 174/93
9,106,030 B2 * 8/2015 Zahnen ..... H01R 13/44
9,216,530 B2 * 12/2015 Vaccaro ..... B29C 45/261
9,265,165 B2 * 2/2016 Hein ..... H01R 13/5205
2012/0238120 A1 9/2012 Huang
2013/0143431 A1 6/2013 Lin
2015/0017827 A1 * 1/2015 Vaccaro ..... H02G 1/14 439/275

FOREIGN PATENT DOCUMENTS

CN 203553564 U 4/2014
CN 204011898 U 12/2014
TW M494400 U 1/2015

* cited by examiner

CONNECTOR STRUCTURE OF TRANSMISSION LINE AND TRANSMISSION LINE

CROSS REFERENCE TO RELATED APPLICATIONS

This Non-provisional application claims priority under 35 U.S.C. §119(a) on Patent Application No(s). 104102521 filed in Taiwan, Republic of China on Jan. 26, 2015, the entire contents of which are hereby incorporated by reference.

BACKGROUND OF THE INVENTION

Field of Invention

The invention is relative to a connector structure of a transmission line and a transmission line.

Related Art

In the booming era of portable electronic devices, many people probably have several portable electronic devices such as mobile phone, tablet computer, camera, or event data recorder and so on. Because of various kinds of portable electronic devices, the employed specifications of the transmission interface are not the same. Thus, some users may carry transmission lines of different specifications to charge outdoor anytime.

However, it is disturbing to carry various transmission lines of different specifications. Therefore, it is an important subject to provide a connector structure of a transmission line, a transmission and an electronic device appropriate for various specifications.

SUMMARY OF THE INVENTION

In view of foregoing subject, an objective of the present invention is to provide a connector structure of a transmission line and a transmission line for various specifications.

For achieving the above objective, a connector structure of a transmission line according to the present invention is disposed at one end of a cable. The connector structure includes an elastic sleeve, a first connector module and a second connector module. The elastic sleeve includes an opening or a slit. The first connector module is covered by the elastic sleeve. One end of the first connector module includes a first plug, the other end of the first connector module includes a first socket. The second connector module is covered by the elastic sleeve. One end of the second connector module includes a second plug. The other end of the second connector module is connected to the cable. The second plug is pluggably connected to the first socket. The opening or the slit is located adjacent to a junction part between the first connector module and the second connector module.

For achieving the above objective, a transmission line according to the present invention includes a cable and a connector structure. The connector structure is disposed at one end of the cable. The connector structure includes an elastic sleeve, a first connector module and a second connector module. The elastic sleeve includes an opening or a slit. The first connector module is covered by the elastic sleeve. One end of the first connector module includes a first plug and the other end of the first connector module includes a first socket. The second connector module is covered by the elastic sleeve. One end of the second connector module includes a second plug. The other end of the second connector module is connected to the cable. The second plug is pluggably connected to the first socket. The opening or the slit is disposed adjacent to a junction part between the first connector module and the second connector module.

In one embodiment, the second plug is detached from the first socket when the elastic sleeve together with the first connector module are outstretched along a direction being away from the second connector module.

In one embodiment, the second plug protrudes from the opening or the slit when the elastic sleeve together with the first connector module are bent along a direction being away from the opening or the slit.

In one embodiment, the first plug is exposed from the elastic sleeve.

In one embodiment, the connector structure further includes a functional module covered by the elastic sleeve. The functional module has a second socket, and the first plug is pluggably connected to the functional module.

In one embodiment, the second connector module further includes a functional component located on at least one side of the second plug.

In one embodiment, the material of the elastic sleeve includes rubber, silicone rubber, polyurethane, polyimide or a combination of those.

For achieving the above objective, a connector structure of a transmission line according to the present invention is disposed at one end of a cable. The connector structure includes a covering element, a first connector module and a second connector module. The covering element includes two covering parts and at least one elastic part. The elastic part is connected between the two covering parts. The first connector module is covered by one of the covering parts. One end of the first connector module includes a first plug and the other end of the first connector module includes a first socket. A second connector module is covered by the other covering part. One end of the second connector module includes a second plug and the other end of the second connector module is connected to the cable. The second plug is pluggably connected to the first socket.

In one embodiment, when each of the two covering parts is detached from the first connector module and the second connector module, the elastic part is outstretched to expose the second plug from the elastic part.

In one embodiment, the first connector module includes a first stop part radially extending from one end of the first plug.

In one embodiment, the connector structure further includes a functional module covered by the covering part, and the first plug is pluggably connected to the functional module.

In one embodiment, the second connector module further includes a functional component located on at least one side of the second plug.

In one embodiment, the material of the elastic sleeve includes rubber, silicone rubber, polyurethane, polyimide or a combination of those.

In summary, because the transmission line and its connector structure utilize the design that the covering part covers the first connector module and the second connector module, users can choose the plug employing applicable specification to transmit signals or electric power. Thus, the users do not need to prepare various transmission lines complying with different specifications for different transmission interfaces. When users use the second plug to perform transmission, the first connector module is still received in the elastic sleeve thus avoiding being separated or lost.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

A connector structure of a transmission line and a transmission line according to a preferred embodiment of he present invention will be apparent from the following detailed description, which proceeds with reference to the accompanying drawings, wherein the same references relate to the same elements.

Figure 1A:
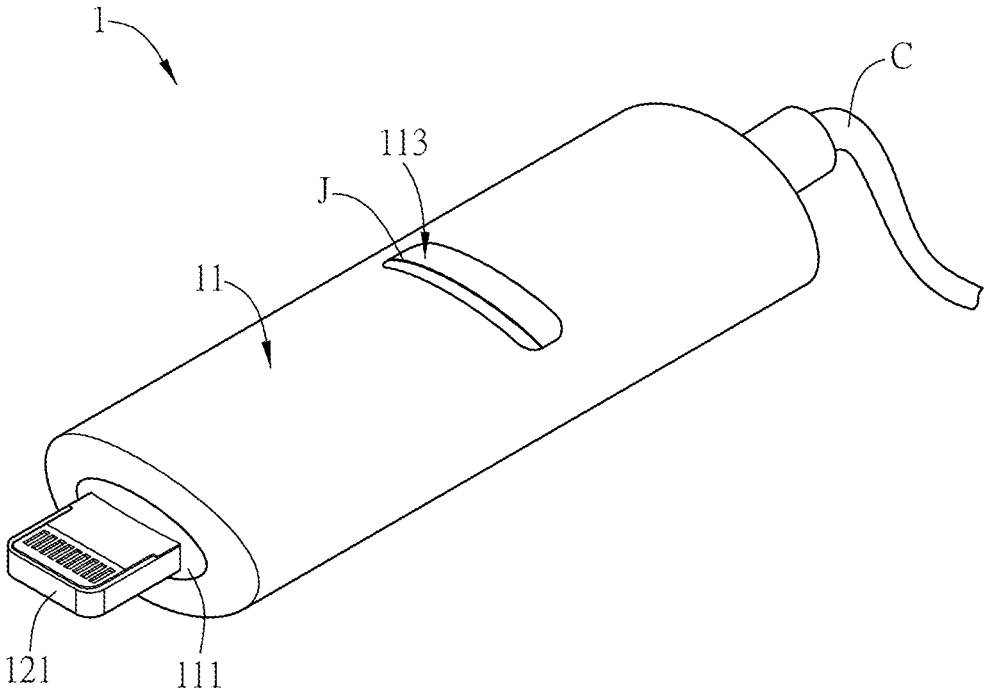
FIG. 1A is a perspective view showing a connector structure of a transmission line according to a preferred embodiment of the present invention.
Figure 1B:
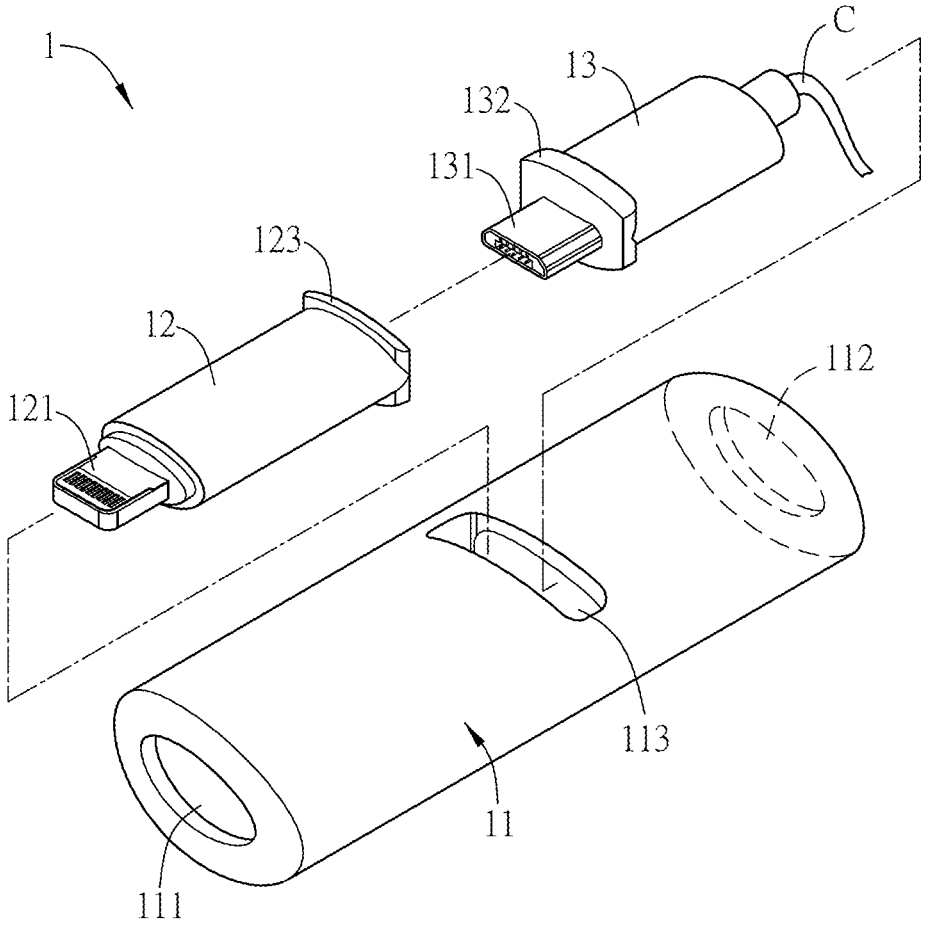
FIG. 1B is an exploded view showing the connector structure in FIG. 1A.

FIG. 1A is a perspective view showing a connector structure of a transmission line according to a preferred embodiment of the present invention. FIG. 1B is an exploded view showing the connector structure in FIG. 1A. Referring to FIGS. 1A-1B, the connector structure 1 of the transmission line is disposed at one end of a cable C. The connector structure 1 includes an elastic sleeve 11, a first connector module 12 and a second connector module 13.

In the embodiment, the elastic sleeve 11 is a hollow cylindrical sleeve for covering the first connector module 12 and the second connector module 13. The elastic sleeve 11 includes two end openings 111, 112 opposite to each other. The diameter of the end openings 111, 112 is smaller than the inner diameter of the elastic sleeve 11. It is noted that the elastic sleeve 11 can includes thick materials, for example but not limited, such as rubber, silicone rubber, polyurethane, polyimide or a combination of those. Thus, users can outstretch the elastic sleeve 11, and the elastic sleeve 11 can be reinstated after the elastic sleeve 11 is not outstretched. Additionally, in the embodiment, the elastic sleeve 11 does not cover the cable C. In other embodiment, the elastic sleeve 11 may cover cable C, which is not limited herein.

The first connector module 12 is covered by the elastic sleeve 11. One end of the first connector module 12 includes a first plug 121 and the other end of the first connector module 12 includes a first socket 122 (referring to FIG. 3). In the embodiment, the first plug 121 is a plug complying with Lightning specification of Apple Inc. and the first socket 122 is a micro universal serial bus socket (Micro USB socket). Additionally, the first plug 121 and the first socket 122 are located at two opposite ends of the first connector module 12 in the embodiment. In the embodiment, the first plug 121 is exposed from the elastic sleeve 11. As shown in FIG. 1A, the first plug 121 passes through the end opening 111 to be exposed from one end of the elastic sleeve 11. Additionally, the first connector module 12 has adapter function for converting between signals complying with the specifications employed by the first socket 122 and the first plug 121. For instance, the conversion is between Lightning specification and Micro USB specification in the embodiment.

The second connector module 13 is covered by the elastic sleeve 11. One end of the second connector module 13 includes a second plug 131, and the other end of the second connector module 13 is connected to the cable C. In the embodiment, the second plug 131 is a Micro USB plug, and it can be pluggably connected to the first socket 122. Additionally, in the embodiment, the end of the second connector module 13 is exposed from the end opening 112 to connect to the cable C.

Figure 1C:
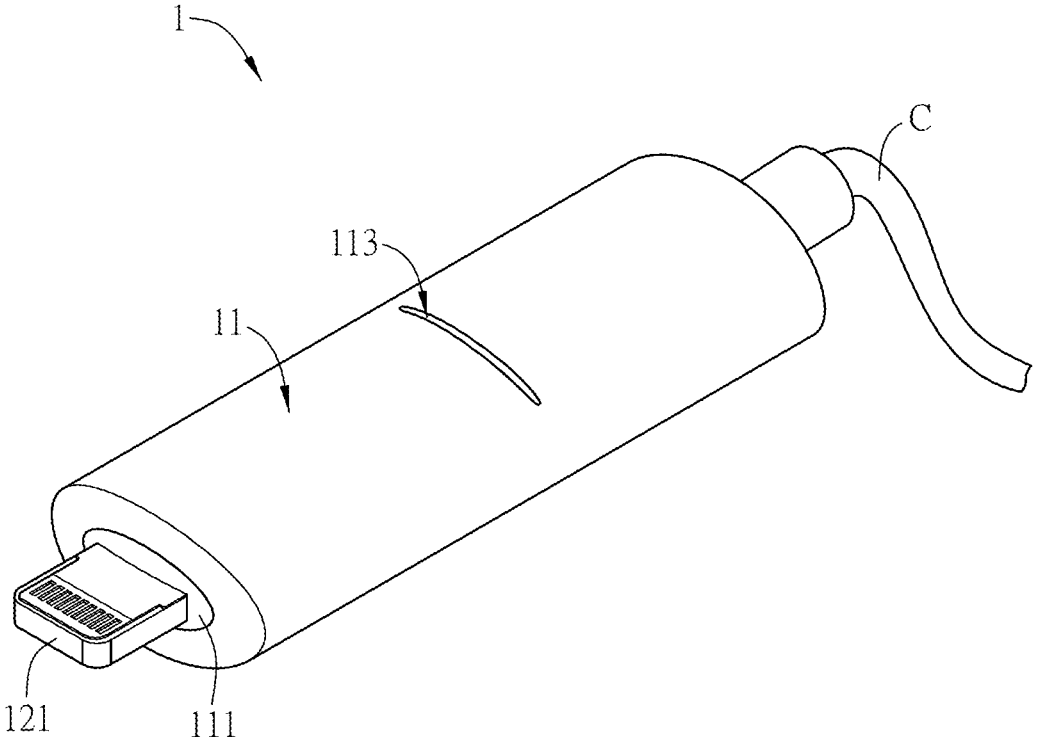
FIG. 1C is a perspective view showing another type of the connector structure in FIG. 1A.

In the embodiment, the first connector module 12 is connected to the second connector module 13 by plugging the second plug 131 into the first socket 122. The elastic sleeve covers the first connector module 12 and the second connector module 13 together. Herein, the elastic sleeve 11 includes an opening or a slit 113. In the following embodiment, the opening is illustrated. The example of slit 131 can be referred to FIG. 1C, and the function of the slit is the same as that of the opening. The opening 113 is located on a sidewall along the radial direction of the elastic sleeve 11, and it is correspondingly located at a junction part J adjacent to the first connector module 12 and the second connector module 13. Therefore, the transmission line in the embodiment can transmit signals or electric power complying with Lightning specification employed by the first plug 121.

It should be noted that the junction part J is an abutting surface connecting the first connector module 12 and the second connector module 13. Various examples which the opening (slit) 113 is adjacent to the junction part J can include following implementation: the junction part J is located within the opening (slit) 113; the junction part J is located at the edge of the opening (slit) 113; or the junction part J is away from the opening (slit) 113 within about 20 nm. For instance, the opening (slit) 113 is located above the second connector module 13, and it is 20 nm or less distant from the junction part J.

Figure 2A:
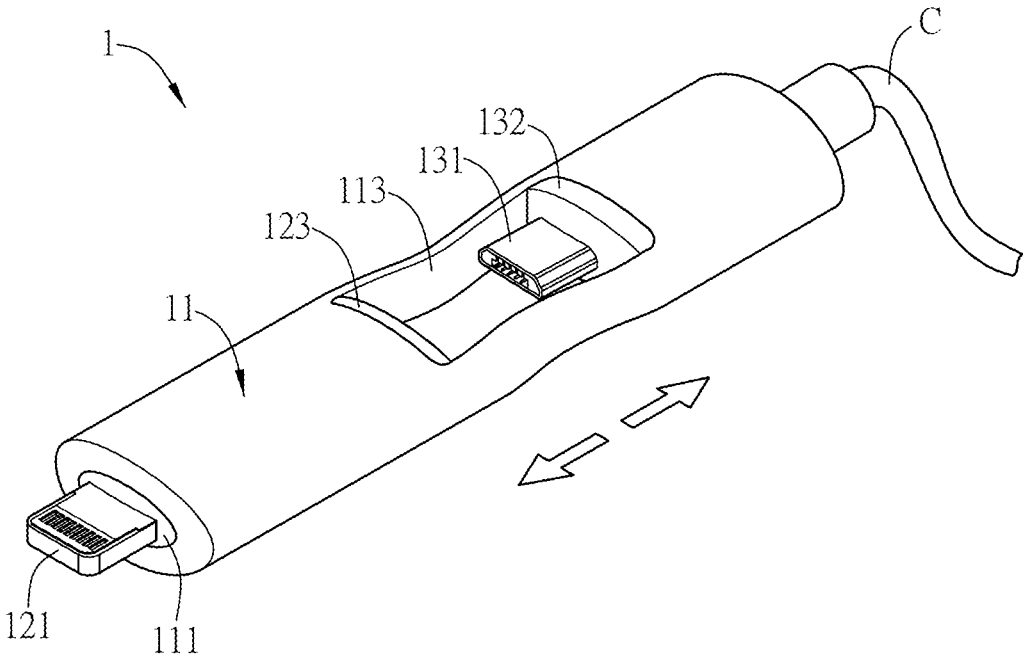
FIG. 2A is a schematic view showing an operation state of the connector structure in FIG. 1A.
Figure 2B:
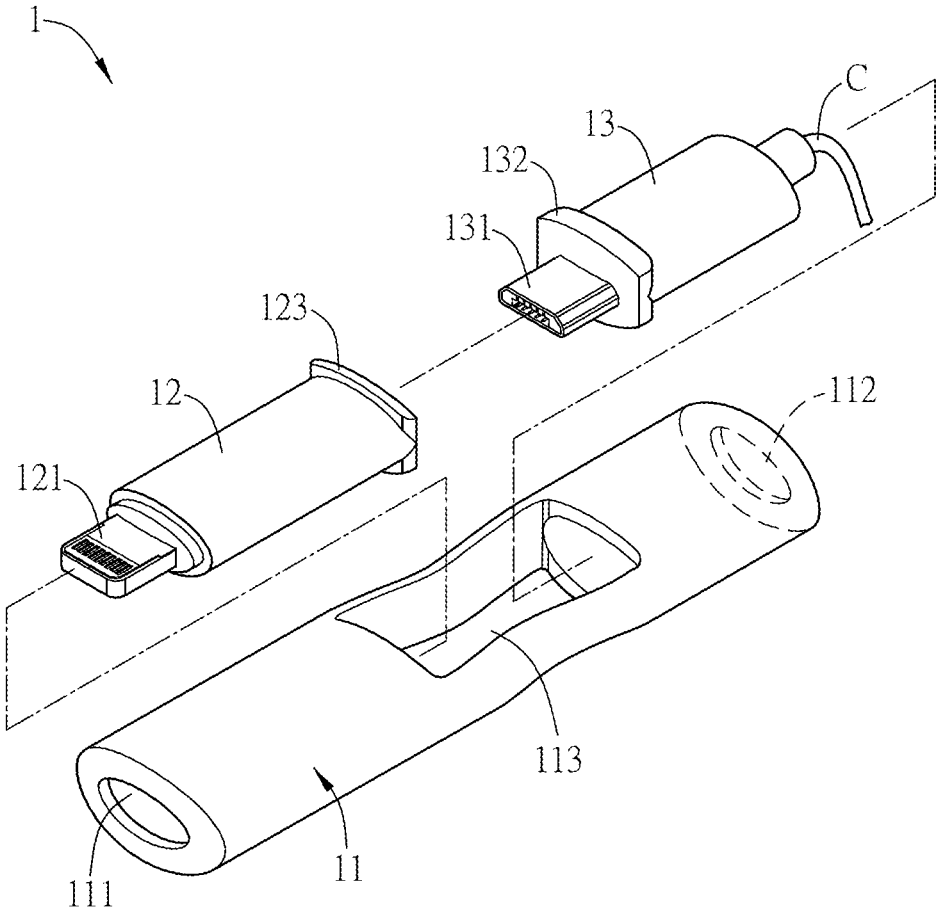
FIG. 2B is an exploded view showing the connector structure in FIG. 2A.

FIG. 2A is a schematic view showing an operation state of the connector structure in FIG. 1A. FIG. 2B is an exploded view showing the connector structure in FIG. 2A. Referring to FIGS. 2A-2B and FIGS. 1A-1B, when the elastic sleeve 11 together with the first connector module 12 are outstretched along a direction being away from the second connector module 13, the second plug 131 is detached from the first socket 122. In the meantime, the size of the opening 113 is also increased by outstretching the elastic sleeve 11. In addition, because the opening 113 is located at the junction part J between the first connector module 12 and the second connector module 13, the second plug 131 is still located in a zone which the opening 113 is projected onto when the elastic sleeve 11 is outstretched.

Figure 3:
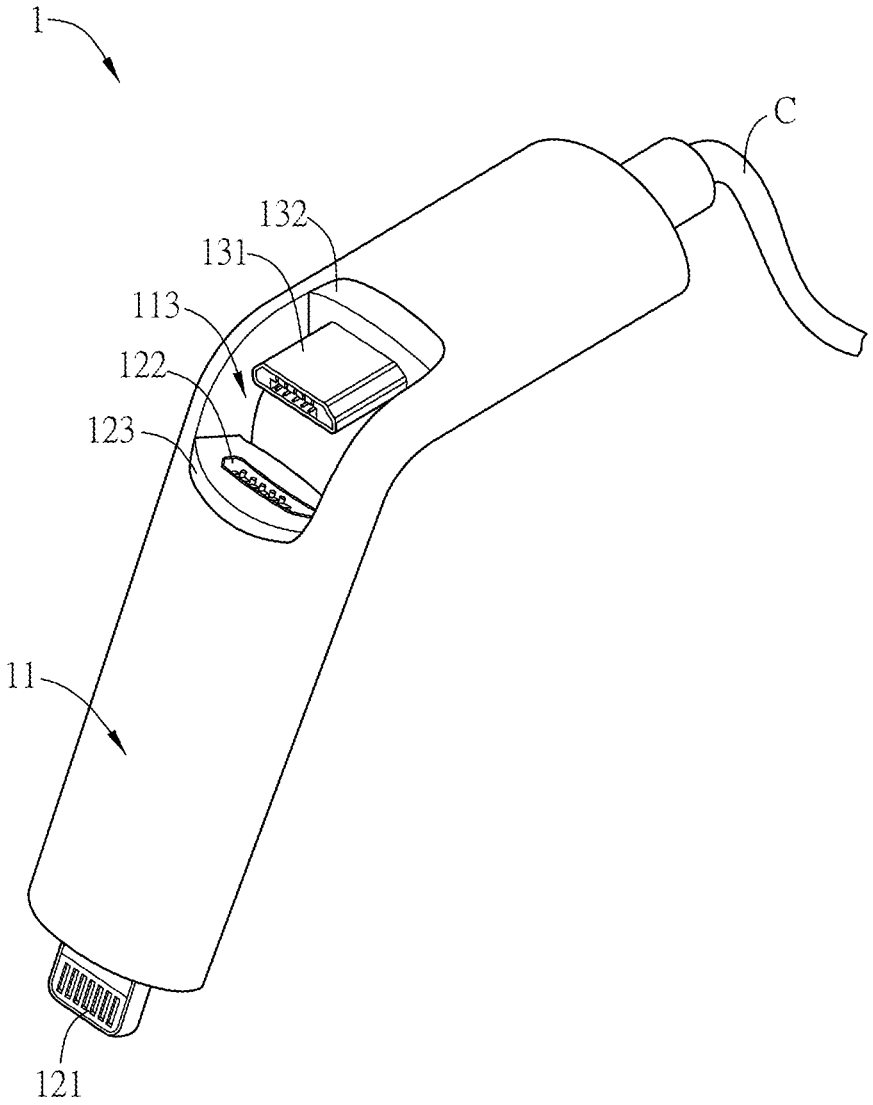
FIG. 3 is a schematic view showing another operation state of the connector structure in FIG. 1A.

Then referring to FIG. 3, FIG. 3 is a schematic view showing another operation state of the connector structure in FIG. 1A. When the elastic sleeve 11 is outstretched as shown in FIG. 2, users can bend the elastic sleeve 11 together with the first connector module 12 along the direction being away from the opening 113 to protrude the second plug 131 from the opening 113. Therefore, the transmission line of the embodiment can transmit signals or electric power complying with Micro USB specification via the second plug 131.

On the whole embodiment, when the first connector module 12 is connected to the second connector module 13, users can transmit signals or electric power complying with the specification employed by the first plug 121. When the second connector module 13 is not connected to the first connector module 12 and the second plug 131 is exposed from the opening 113 by outstretching and bending the elastic sleeve 11, users can transmit signals or electric power complying with the specification employed by the second plug 131. Therefore, users can choose an applicable plug to transmit signal or electric power, and they do not need to prepare various transmission lines complying with different specifications for different transmission interfaces. Moreover, because the elastic sleeve 11 covers the first connector module 12 and the second connector module 13 together, the first connector module 12 is still received in the elastic sleeve 11 thus avoiding being separated or lost when users use the second plug 131 to perform transmission.

It is noted that although the connector structure 1 employing Lightning specification and Micro USB specification is exampled in the embodiment, in fact, users can select different applicable plugs on demand or by preference according to usage requests such as conversion between Micro USB A-type and Micro USB B-type, or conversion between mini USB and Micro USB, etc. Preferably, users can prepare several first connector modules 12 complying with different specifications to replace with applicable plug to transmit signals or electric power on various demand.

In addition, users can also change the elastic sleeve 11 with different color on various demands, so that the transmission line looks beautiful and fashionable. In some embodiments, the elastic sleeve 11 can be printed with figures or words such as logo, connector model or symbols. In some embodiments, the elastic sleeve 11 can be added with heat sensitive materials during manufacturing. When the connector structure 1 is overheated, the elastic sleeve 11 can change itself with different color to notice users. Additionally, the elastic sleeve 11 may be added with luminescent materials, so that users can easily recognize the location of the connector structure 1 in dark environment.

During manufacturing, the elastic sleeve 11 can be formed by injection molding, for example, by insert molding together with the first connector module 12 and the second connector module 13 put in the mold. It means that the elastic sleeve 11 is injected directly to cover the first connector module 12 and the second connector module 13. Thus, the strength and the adaptation of the elastic sleeve 11, the first connector module 12 and the second connector module 13 can be enhanced, and some manufacturing processes can be eliminated. In some embodiments, the elastic sleeve 11 can be separately molded by injection and then receive the assemblages of the first connector module 12 and the second connector module 13. It is beneficial to replace the connector module and the elastic sleeve 11. The above manufacturing method is illustrated as an example, which is not limited herein.

In some embodiments, as shown in FIG. 2B, the first connector module 12 includes a first stop part 123 radially extending from one end of the first socket 122. The first stop part 123 is located at the opening (slit) 113 especially in the zone which the opening (slit) 113 is projected onto. The first stop part 123 may pass through the opening (slit) 113 to be exposed from the elastic sleeve 11. Alternatively, the first stop part 123 may not pass through the opening (slit) 113, which is not limited herein. The outside diameter of the first stop part 123 is wider than the inner diameter of the elastic sleeve 11. Thus, the first stop part 123 can abut the sidewall of the elastic sleeve 11 adjacent to the opening 113 in order to prevent the first connector module 12 being drawn out from the end opening 111. Additionally, the first stop part 123 furtherly stabilizes the location of the first connector module 12, and prevents the elastic sleeve 11 from deformation after being outstretched. Thus, it is smooth to plug the first connector module 12 and the second connector module 13.

Similarly, the second connector module 13 includes a second stop part 132 radially extending from one end of the second plug 131. The second stop part 132 is located at the opening (slit) 113, especially in the zone which the opening (slit) 113 is projected onto. The second stop part 132 may pass through the opening (slit) 113 to be exposed from the opening (slit) 113. Alternatively, the second stop part 132 may not pass through the opening (slit) 113, which is not limited herein. The outside diameter of the second stop part 132 is wider than the inner diameter of the elastic sleeve 11. Thus, the second stop part 132 can abut the sidewall of the elastic sleeve 11 adjacent to the opening 113 in order to prevent the second connector module 13 from being drawn out from the end opening 112. In addition, the second stop part 132 furtherly stabilizes the location of second connector module 13, and prevents the elastic sleeve 11 from deformation after being outstretched. Thus, it is smooth to plug the first connector module 12 and the second connector module 13. Furthermore in the embodiment, when the first connector module 12 is connected to the second connector module 13, the first stop part 123 and the second stop part 132 are abutted by each other.

In addition, the amount of the opening (slit) 113 can be one or plural, and the shape of the opening (slit) 113 can be triangular, rectangular, circular, elliptical or C-shaped. No matter what the shape of the opening (slit) 113 is, it is required that the second plug 131 is exposed from the opening (slit) 113 when the elastic sleeve 11 together with the first connector module 12 are outstretched to bend.

Figure 4:
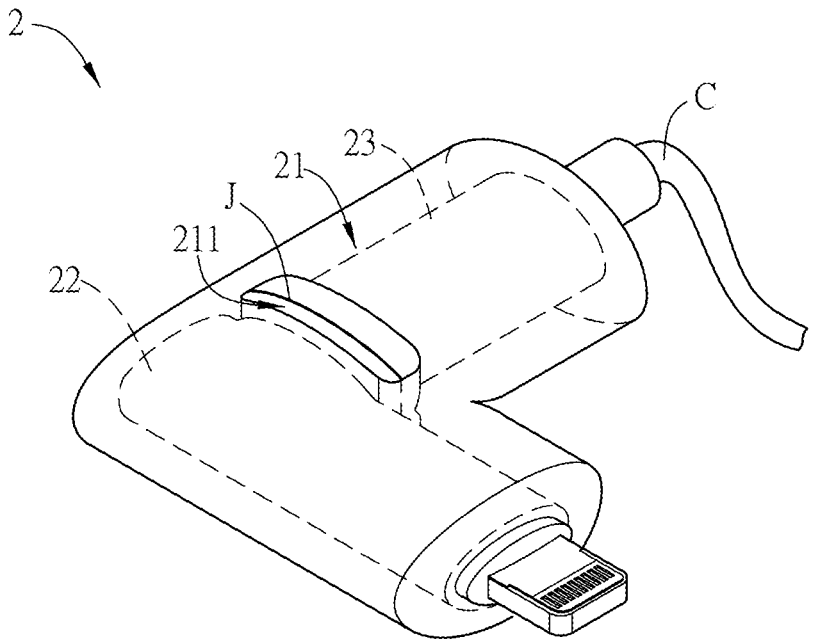
FIG. 4 is a perspective view showing a connector structure of a transmission line according to another embodiment of the present invention.

FIG. 4 is a perspective view showing a connector structure of a transmission line according to another embodiment of the present invention. Referring to FIG. 4, the connector structure 2 of the transmission line is similar to that of the above embodiment, and it includes an elastic sleeve 21, a first connector module 22 and a second connector module 23. In the embodiment, the first connector module 22 and the second connector module 23 are perpendicular and connected to each other. Thus, the connector structure 2 is approximately L-shaped. The elastic sleeve 21 is correspondingly designed to L-shaped to cover the first connector module 22 and the second connector module 23 together. The opening (slit) 211 of the elastic 21 is located at the junction part J between the first connector module 22 and the second connector module 23. Because descriptions for the connector structure 2 can be referred to the above embodiment, they are not repeated here again.

Figure 5:
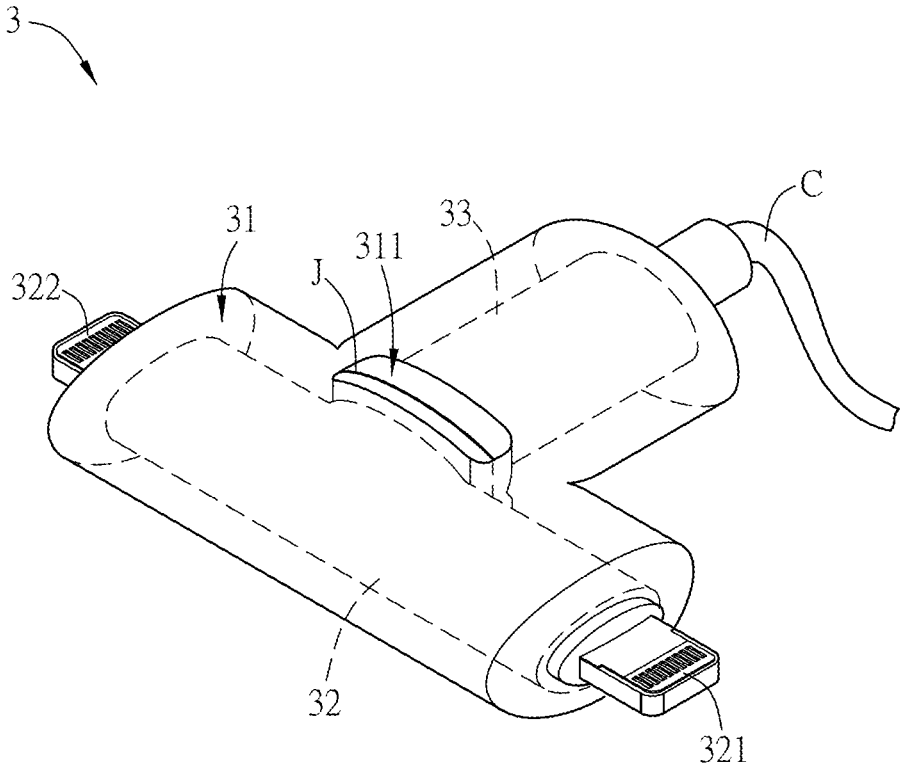
FIG. 5 is a perspective view showing a connector structure of a transmission line according to another embodiment of the present invention.

FIG. 5 is a perspective view showing a connector structure of a transmission line according to another embodiment of the present invention. Referring to FIG. 5, the connector structure 3 of the transmission line is similar to that of the above embodiment, and it includes an elastic sleeve 31, a first connector module 32 and a second connector module 33. In the embodiment, the two ends of the first connector module 32 respectively include a first plug 321 and a second plug 322. Preferably, the specification employed by the first plug 321 is different from that of the second plug 322. In addition, the sidewall of the first connector module 32 includes a first socket (not shown). Thus, the first connector module 32 is perpendicular and connected to the second connector module 33, and the connector structure 3 is approximately T-shaped. The elastic sleeve 31 is correspondingly designed to T-shaped to cover the first connector module 32 and the second connector module 33 together. Similarly, the opening (slit) 311 of the elastic sleeve 31 is located at the junction part J between the first connector module 32 and the second connector module 33. Because descriptions for the connector structure 3 can be referred to the above embodiment, they are not repeated here again.

Figure 6A:
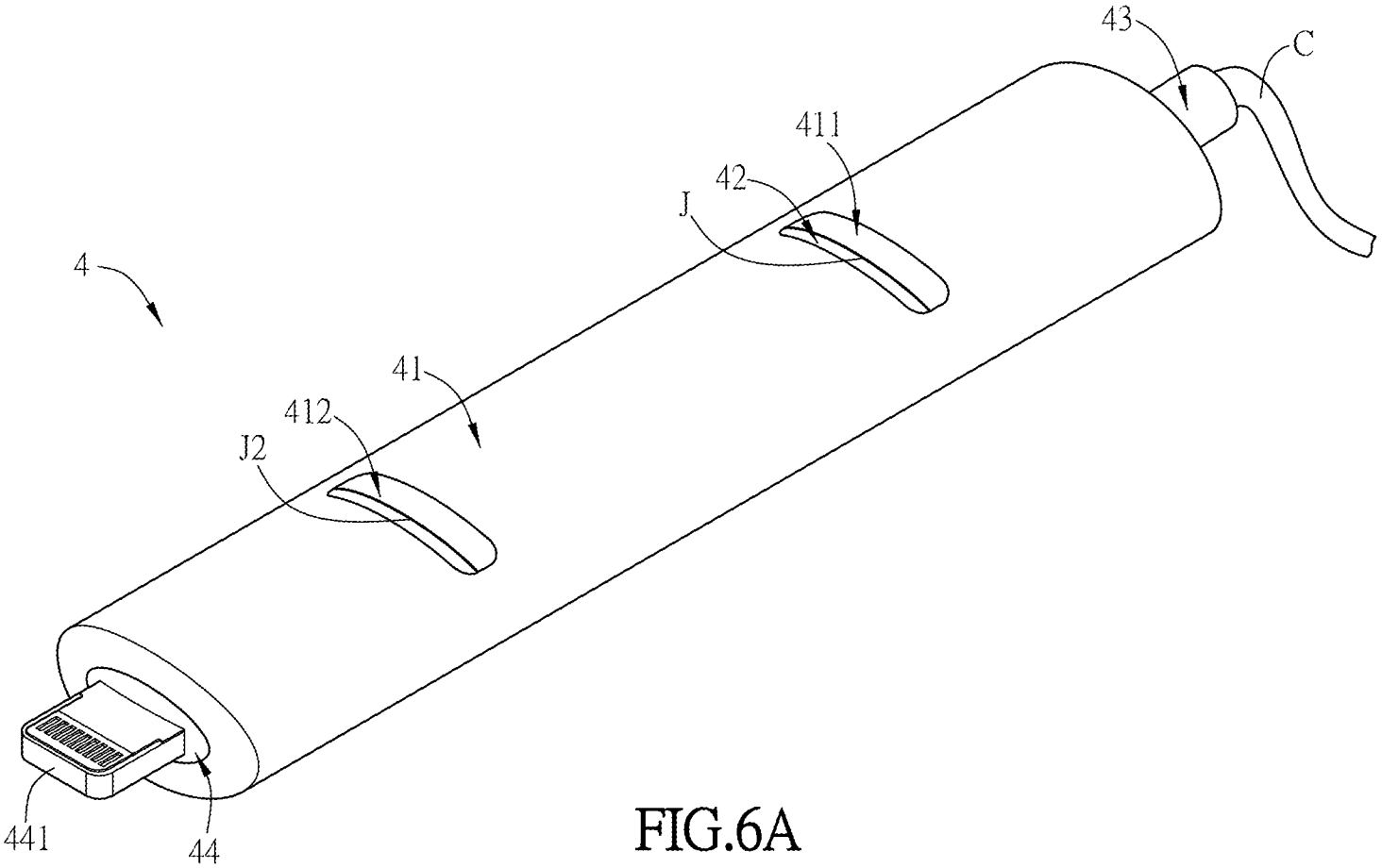
FIGS. 6A-6C are perspective views showing a connector structure of a transmission line according to another embodiment of the present invention.
Figure 6B:
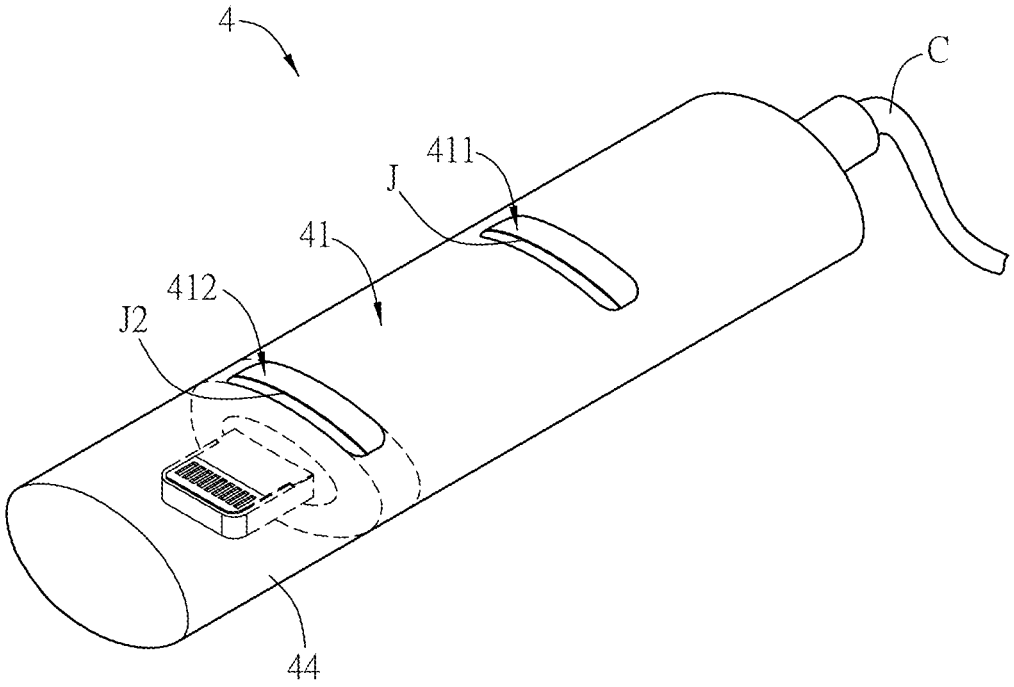
Figure 6C:
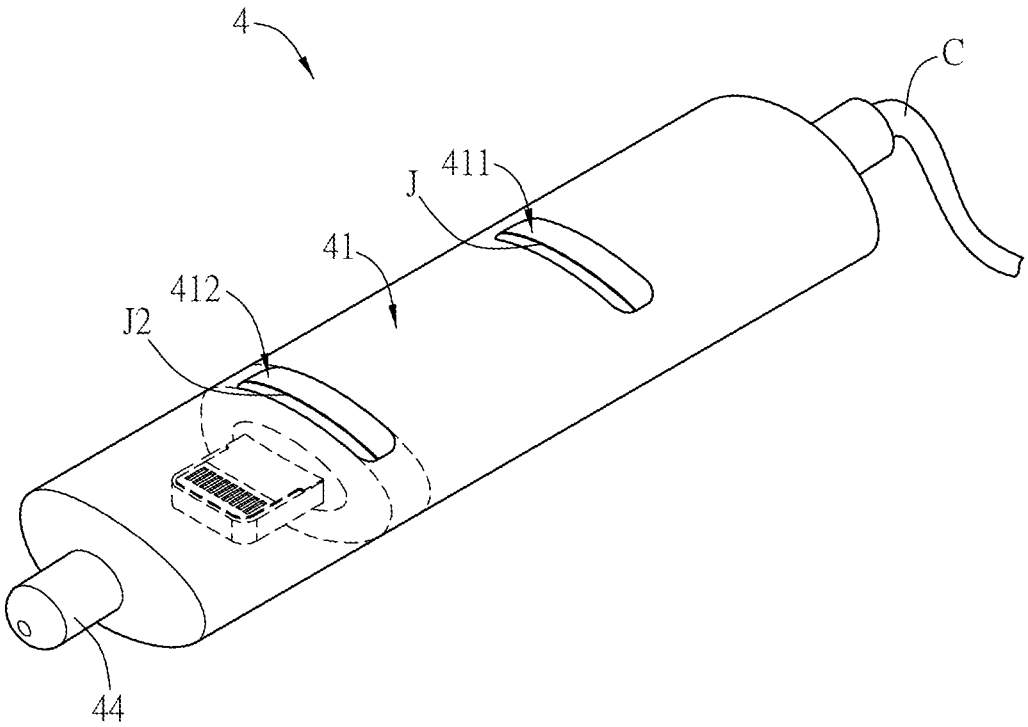

FIGS. 6A-6C are perspective views showing a connector structure of a transmission line according to another embodiment of the present invention. Referring to FIG. 6, the connector structure 4 of the transmission line is similar to that of the above embodiment, and it includes an elastic sleeve 41, a first connector module 42 and a second connector module 43. In the embodiment, the connector structure 4 further includes a functional module 44 covered by the elastic sleeve 41. It means that the elastic sleeve 41 covers all of the first connector module 42, the second connector module 43 and the functional module 44 together. The actual design of the functional module 44 depends on demand. For instance, the functional module 44 can be a protection cover (as shown in FIG. 6B), a laser pen (as shown in FIG. 6C), a flashlight, or an additional connector module. In the embodiment, the functional module 44 is an additional connector module for illustration. Herein, one end of the functional module 44 includes a third plug 441, and the other end of the functional module 44 includes a second socket (not shown). The first plug can be pluggably connected to the second socket. Although the second socket is not shown in the figure, the specification employed by the second plug is corresponding to that of the first plug, namely, like the connection relationship of the first socket 122 and the second plug 131 shown in FIG. 3. It should be understood by the person of ordinary skill in the art. Similarly, the opening (slit) 411 of the elastic sleeve 41 is located at the junction part J between the first connector module 42 and the second connector module 43. In addition, the elastic sleeve 41 further includes a second opening (slit) 412 located at a junction part J2 between the first connector module 42 and the functional module 44. Thus, the connector structure 4 can include the plugs employing three kinds of specifications for use. Because descriptions for the connector module 4 can be referred to the above embodiment, they are not repeated here again.

Figure 7:
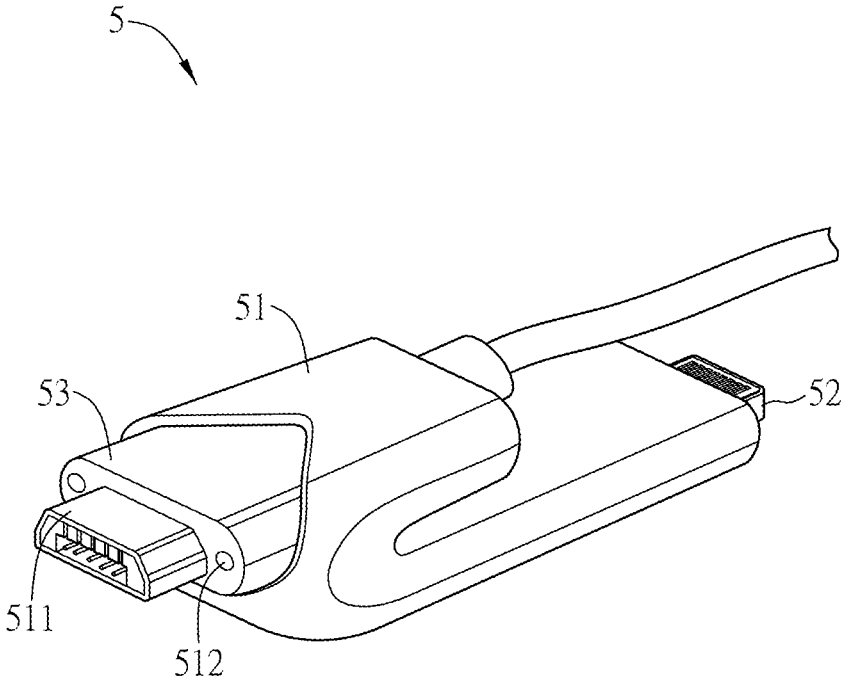
FIG. 7 is a schematic view showing an operation state of a connector structure of a transmission line according to another embodiment of the present invention.

FIG. 7 is a schematic view showing an operation state of a connector structure of a transmission line according to another embodiment of the present invention. Referring to FIG. 7, the connector structure 5 similarly includes an elastic sleeve 51, a first connector module 52 and a second connector module 53. Because the structure and the connection relationship of components are described in the above embodiment, they are not repeated here again. In the embodiment, the second connector module 53 includes a second plug 511 and a functional element 512. The functional element 512 is located on at least one side of the second plug 511. In the embodiment, the functional element 512 is a light emitting element (for example a LED light). When users need a light, they can outstretch and bend the elastic sleeve 51 together with the first connector module 52 to expose the functional element 512. In one implementation, when the first connector module 52 is connected to the second connector module 53, the functional element 512 is in short circuit manner and not in operation because the second plug 511 is connected to the first socket (not shown) of the first connector module 52. When the second plug 511 is separated from the first socket, the functional element is in operation (LED light is turned on). In addition, in some embodiment, the functional element 512 may be integrated with the second plug 511 as a single component. For example, the LED light is embedded into the inner edge of the metal frame of the second plug 511, or it and the pins of the second plug 511 are disposed side by side.

Figure 8A:
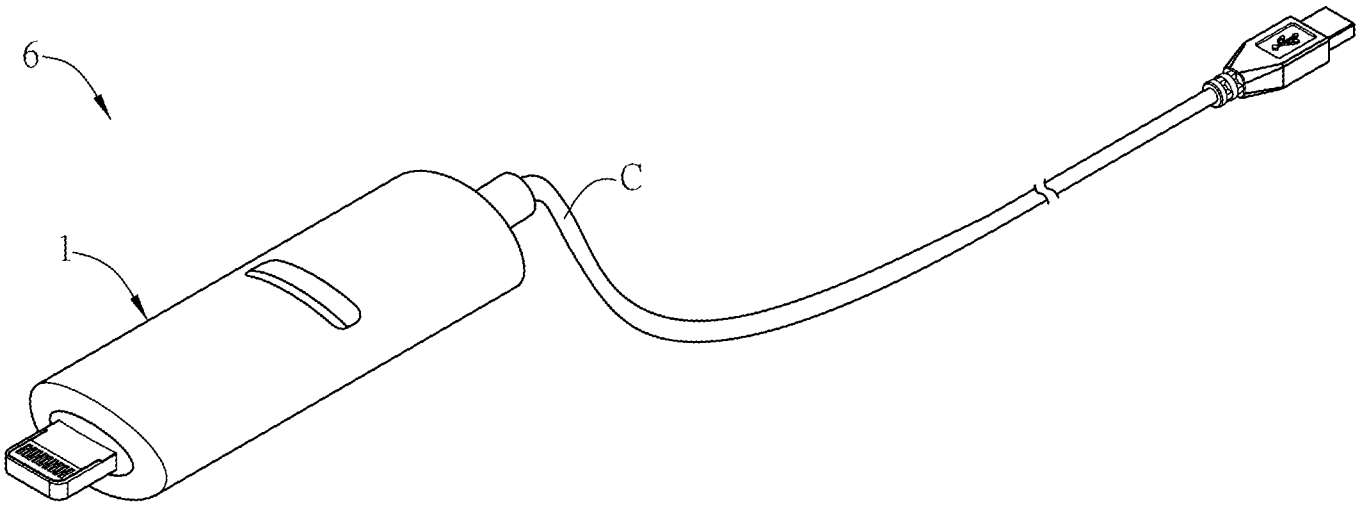
FIG. 8A and FIG. 8B are perspective views showing a transmission line according to the preferred embodiment of the present invention.
Figure 8B:
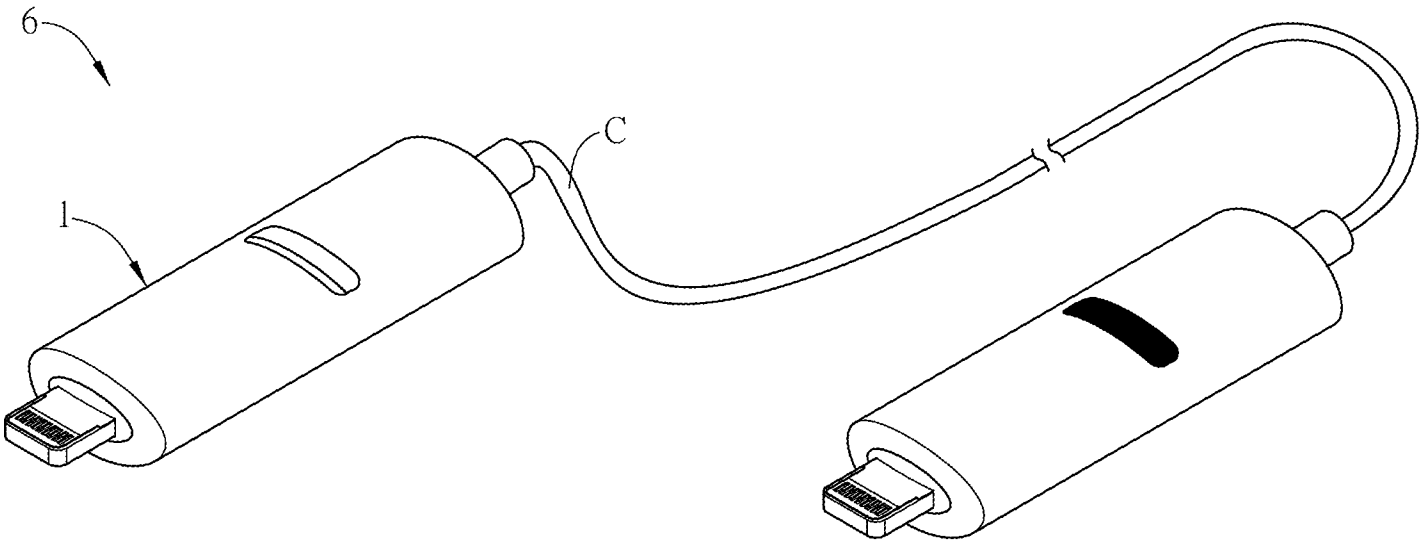

FIG. 8A is a perspective view showing a transmission line according to a preferred embodiment of the present invention. Referring to FIG. 8A, the transmission line 6 includes the cable C and the connector structure 1. The connector structure 1 is disposed at one end of the cable C. Because descriptions for the connector structure 1 can be referred to the above embodiment, they are not repeated here again. In the embodiment, the other end of the cable C may be a Micro USB connector, or it may employ other specification on demand. Besides, both two ends of the cable C may be the connector structure 1 as shown in FIG. 8B, which are not limited herein.

Figure 9:
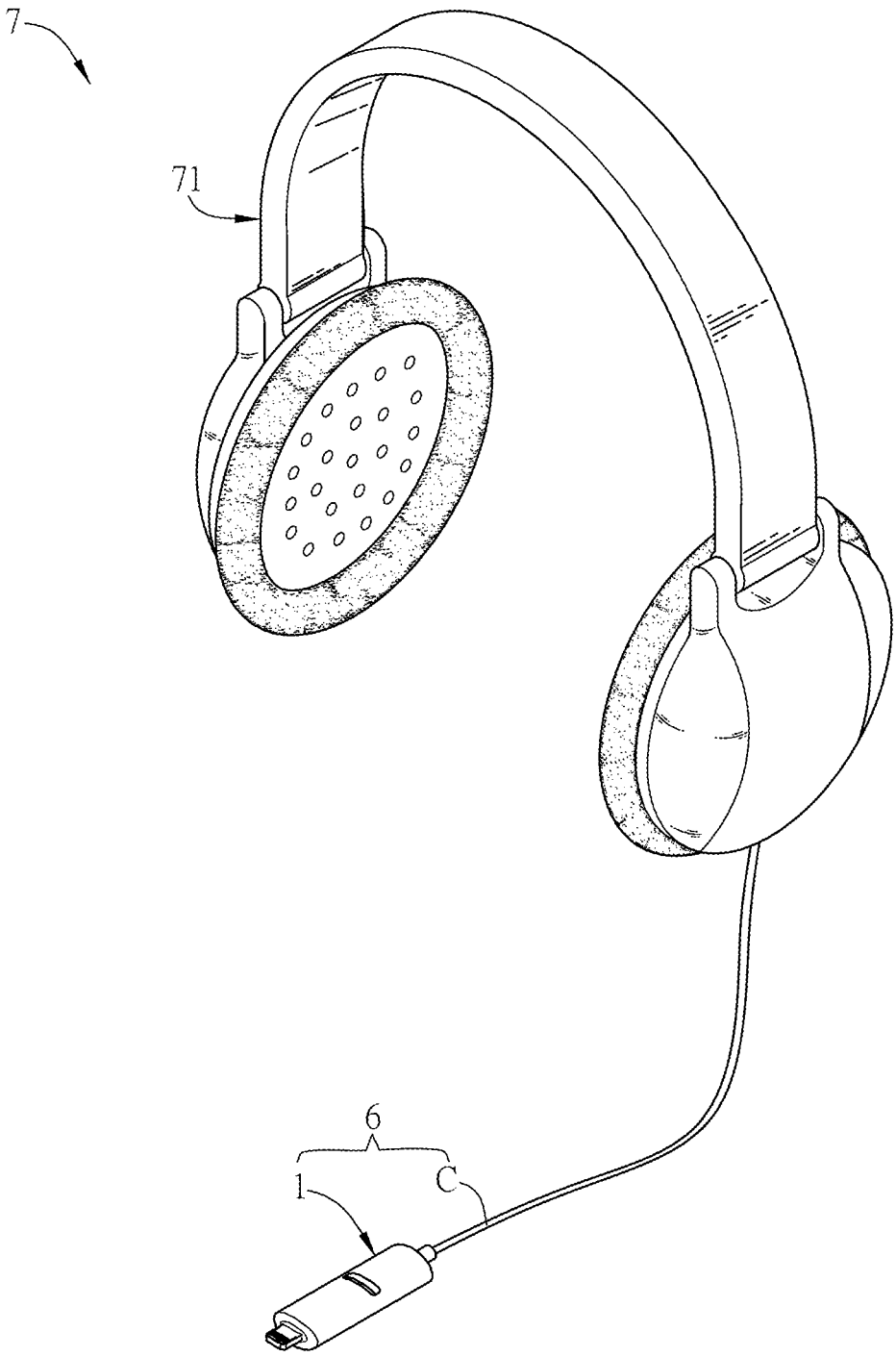
FIG. 9 is a perspective view showing an electronic device according to the preferred embodiment of the present invention.

FIG. 9 is a perspective view showing an electronic device according to a preferred embodiment of the present invention. An electronic device 7 includes an electronic device body 71 and a transmission line 6. Because the transmission line 6 is connected to the electronic device 71. Because descriptions for the transmission line 6 can be referred to the above embodiment, they are not repeated here again. In the embodiment, the electronic device 7 is a headphone as example for illustration. The headphone (electronic device 7) of the embodiment can be connected to a mobile phone, a computer or other electronic device through the connector structure 1 of the transmission line 6. It can be applied to different specification by choosing suitable plug in use. In addition, in some embodiments, the electronic device body 71 and the transmission line 6 may be implemented as an unseparated device, such as mouse, keyboard, joystick and so on. Alternatively, they may be implemented as a pluggable device such as mobile phone, notebook computer, camera, power bank, car charger or adaptor and son on, which is not limited herein.

Figure 10A:
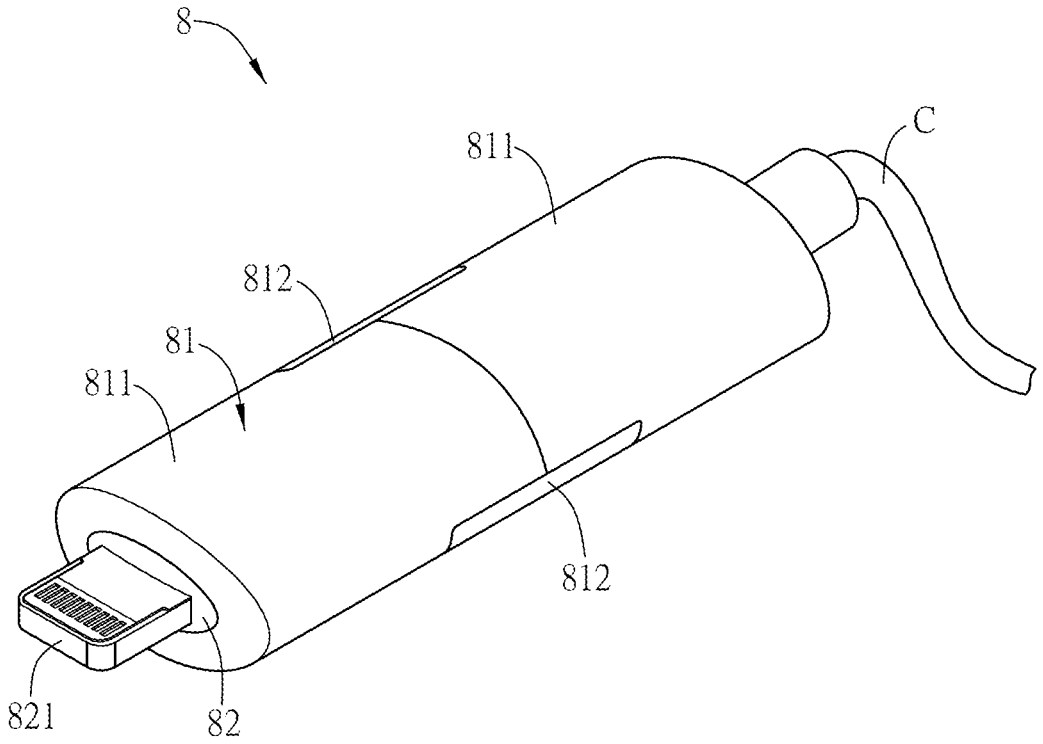
FIG. 10A and FIG. 10B are perspective views of a connector structure of a transmission line according to another embodiment of the present invention.
Figure 10B:
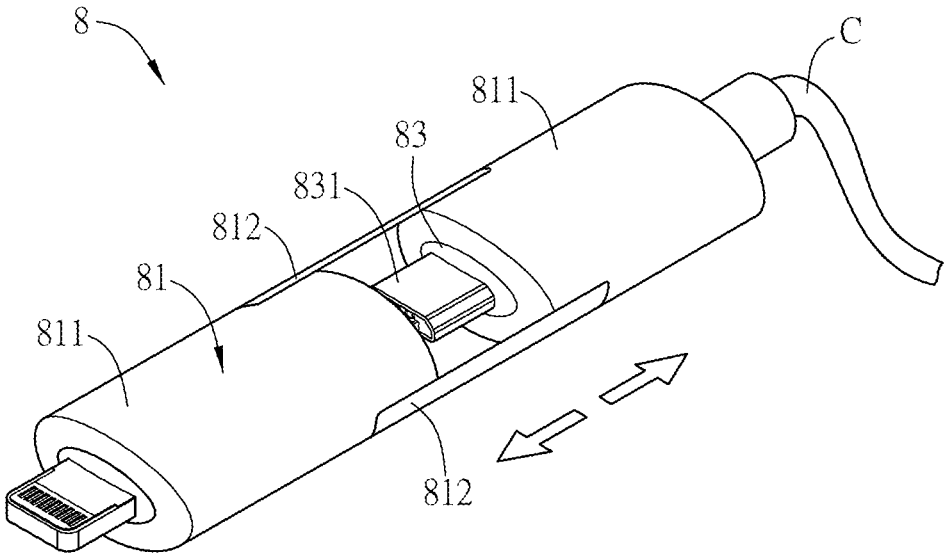

FIG. 10A and FIG. 10B are perspective views showing a connector structure of a transmission line according to another embodiment of the present invention. The connector structure 8 includes a covering element 81, a first connector module 82 and a second connector module 83. In the embodiment, the covering element 81 includes two covering parts 811 and two elastic parts 812. The elastic parts 812 are connected between the two covering parts 811. Each of the covering parts 811 covers the first connector module 82 and the second connector module 83, respectively. The covering parts 811 can be made of elastic materials (such as rubber, silicon rubber, polyurethane, polyimide or a combination of those) or non-elastic materials. In the embodiment, the covering parts are made of non-elastic material. The elastic part 812 can be located adjacent to the junction part between the first connector module 82 and the second connector module 83. Thus, the first plug 821 of the first connector module 82 can be used when the first connector module 82 is connected to the second connector module 83. When each of the covering parts 811 respectively together with the first connector module 82 and the second connector module 83 are detached from each other, the elastic parts 812 can be outstretched and bent to expose the second plug 831 of the second connector module 83 for use. It is noted that although the two elastic parts are strip-shaped in the embodiment, the elastic parts can be sheet-shaped, ring-shaped or other shape, and the amount of the elastic parts can be one or plural, which is not limited herein.

In some embodiment, the first connector module 82 can further include a first stop part (not shown) radially extending form one end of the first plug (referring to FIG. 3) Similarly, the second connector module 83 can further includes a second stop (not shown) radially extending from one end of the second plug 831. Because descriptions for the first stop part and the second stop part can be referred to above embodiment, they are not repeated here again.

In addition, the connector structure 8 can further include a functional module covered by the covering element 81. The first plug 821 can be pluggably connected to the functional module. Similarly, the second connector module 83 can also include a functional component disposed on at least one side of the second plug 831. Because descriptions for the functional module and the functional component can be referred to the above embodiment, they are not repeated here again.

In summary, because the transmission line and its connector structure utilize the design that the covering part covers the first connector module and the second connector module, users can choose the plug employing applicable specification to transmit signals or electric power. Thus, the users do not need to prepare various transmission lines complying with different specifications for different transmission interfaces. When users use the second plug to perform transmission, the first connector module is still received in the elastic sleeve thus avoiding being separated or lost.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A connector structure of a transmission line disposed at one end of a cable, the connector structure comprising:

an elastic sleeve comprising an opening or a slit;

a first connector module covered by the elastic sleeve, wherein one end of the first connector module has a first plug, and the other end of the first connector module has a first socket; and a second connector module covered by the elastic sleeve, wherein one end of the second connector module has a second plug, the other end of the second connector module is connected to the cable, and the second plug is pluggably connected to the first socket;

wherein the opening or the slit is located adjacent to a junction part between the first connector module and the second connector module, wherein the second plug is detached from the first socket when the elastic sleeve together with the first connector module are outstretched along a direction being away from the second connector module.

2. The connector structure of claim 1, wherein the second plug is protruded from the opening or the slit when the elastic sleeve together with the first connector module are bent along a direction being away from the opening or the slit.

3. The connector structure of claim 1, wherein the first plug is exposed from the elastic sleeve.

4. The connector structure of claim 1, further comprising a functional module covered by the elastic sleeve wherein the first plug is pluggably connected to the functional module.

5. The connector structure of claim 1, wherein the second connector module further comprises a functional component located on at least one side of the second plug.

6. The connector structure of claim 1, wherein the material of the elastic sleeve comprises rubber, silicone rubber, polyurethane, polyimide or a combination of those.

7. A transmission line comprising:

a cable; and a connector structure disposed at one end of the cable, the connector structure comprising:

an elastic sleeve comprising an opening or a slit;

a first connector module covered by the elastic sleeve, wherein one end of the first connector module has a first plug, and the other end of the first connector module has a first socket; and a second connector module covered by the elastic sleeve, wherein one end of the second connector module has a second plug, and the other end of the second connector module is pluggably connected to the first socket;

wherein the opening or the slit is disposed adjacent to a junction part between the first connector module and the second connector module, wherein the second plug is detached from the first socket when the elastic sleeve together with the first connector module are outstretched along a direction being away from the second connector module.

8. The transmission line of claim 7, wherein the second plug is protruded from the opening or the slit when the elastic sleeve together with the first connector module are bent along a direction being away from the opening or the slit.

9. The transmission line of claim 7, wherein the end of the second connector comprises a second stop part radially extending from one end of the second plug, and the second stop part is located at the opening or the slit.

* * * * *